United States Patent [19]

Domingue

[11] Patent Number: 4,814,766

[45] Date of Patent: Mar. 21, 1989

[54] FIRE ALARM AND HEAT DETECTION SYSTEM AND APPARATUS

[76] Inventor: Willard A. Domingue, 1334 Chamboard, Houston, Tex. 77018

[21] Appl. No.: 129,650

[22] Filed: Dec. 7, 1987

[51] Int. Cl.[4] ..... G08B 17/02; G08B 17/06

[52] U.S. Cl. ..... 340/590; 169/61; 340/577

[58] Field of Search ..... 340/590, 577; 169/61, 169/59, 57, 56

[56] References Cited

U.S. PATENT DOCUMENTS 4,520,352 5/1985 Domingue ..... 340/590

4,575,715 3/1986 Forgione ..... 340/590

*Primary Examiner*—Glen R. Swann III

*Attorney, Agent, or Firm*—Neal J. Mosely

[57] ABSTRACT

A fire alarm and heat detection system and apparatus employs a thermoplastic film tape, of a plastic material which may or may not be heat shrinkable, e.g., polyvinyl chloride, polyethylene, polypropylene, rubber hydrochloride, polyvinylidene chloride, polyester, or nylon, having a substantial drop in tensil strength at a predetermined temperature. A conductor wire is supported on and extends for the entire length of the tape. The wire may be round in cross section or a flat foil and embedded in the tape or formed of two separate film tapes, heat sealed or adhesively laminated together or supported, by printing or the like, on the surface of a single tape. The tape and wire are supported across a supporting frame or yoke having supporting members spring loaded apart to apply a predetermined tension which may be preselected whereby the tape and wire will break on occurrence of a predetermined temperature. A circuit continuity monitoring device is connected to the conductor wire to detect interruption and an alarm mechanism connected thereto generates an alarm signal upon detection of the interruption of continuity of the conductor wire. The system differs from systems utilizing heat shrinkage of a plastic film in that the temperature of operation is variable while the heat shrinkage point is fixed for various plastic films.

20 Claims, 1 Drawing Sheet

FIRE ALARM AND HEAT DETECTION SYSTEM AND APPARATUS

BACKGROUND OF THE INVENTION

1. Field of the Invention

The present invention relates to alarm systems, and particularly to heat sensing systems which are designed to give early warning of a fire before it has progressed to a major blaze.

2. Brief Description of the Prior Art

Every year, in cities and communities across the nation, fire catastrophes cause countless losses of life and property. For example, in the United States fire is the largest single cause of injuries in hotels and motels, 36% of such injuries being caused by smoking in bed. Not counted in such statistics in the untold pain and suffering of those injured in residential and commercial fires. Such statistics cannot begin to reflect the terrible anguish born by these and others not only over the loss of their cherished possessions, but even more over the sufferings and losses of their friends and loved ones.

As technology progresses, and as the public more and more accepts the fact that we all share a common risk and exposure to these sudden and unexpected losses, countermeasures have become increasingly evident. For example, building codes in more and more communities are requiring public buildings, nursing homes, hotels, motels, and so forth to install and maintain smoke detectors and sprinkler systems, to use fire retardant materials, and so on. More and more homeowners are installing smoke detectors in their homes to give early warning of a fire. More expensive residential systems will even transmit an alarm directly to the local authorities when a fire or smoke is detected.

Unfortunately, most such systems are as expensive as they are sophisticated. Their use is therefore restricted to those who can afford them, and even then to only those applications which their users consider to be "cost effective". Additionally, such systems, notwithstanding their sophistication, are often woefully deficient in furnishing the earliest possible warning in certain types of fires. For example, one of the most tragic fires is the mattress fire caused by a smoker who falls asleep while smoking in bed. Such a person can suffer serious body burns (not to speak of the dangers from the smoke and fumes generated by the smoldering mattress fire) long before a conventional smoke or fire detector will respond.

Other examples where inexpensive, versatile detectors would be especially useful include: detecting imminent spontaneous combustion due to unfavorable temperature conditions, as in a closed area; monitoring the condition of goods subject to heat damage during transit and sounding an immediate alarm upon an unfavorable temperature condition, rather than simply activating a tell-tale warning tag which is usually discovered much later after the damage has progressed too far to be corrected; and so forth. Such needs often go unanswered because presently available detectors are simply too expensive for mass use in statistically low-risk situations.

A need thus remains for an inexpensive, uncomplicated, versatile and reliable fire alarm system and method which will give the earliest possible warning of a fire hazard. Preferably such a system and method can be configured to give a warning long before temperatures rise to the point of combustion. In some cases, such as detecting a mattress fire, the warning should be given long before the temperature rises to that of a cigarette, 125020 F. Desirably, such a system and method would lend itself readily to economical use in virtually any environment or application where early and reliable detection of an undesirably high temperature is needed.

The following patents illustrate various prior art concepts having some relevance to this invention:

Girogianni U.S. Pat. No. 2,488,622, issued Nov. 22, 1949, discloses a flash bulb in parallel with a normally closed circuit which fires if the other circuit is broken.

Margulies U.S. Pat. No. 3,158,713, issued Nov. 24, 1964 discloses a latching indicator to indicate an open electrical circuit, such as a blown fuse.

Shiraishi U.S. Pat. No. 3,210,751, issued Oct. 5, 1965, discloses a circuit which requires only a small amount of electricity to monitor a closed loop circuit and actuate an alarm if the loop circuit is broken.

Morreal et al. U.S. Pat. No. 3,367,175, issued Feb. 6, 1968, discloses an ablation sensor containing embedded wires which form a plurality of electrical circuits as they erode, melt, or ablate along with the material on which the wires are supported. Opening of the normally closed circuits thus results, not from fracturing of the conductor caused by thermally induced melting and migration of the adhering substrate material, but by melting and evaporation of the conductor when the adjacent substrate ablates. The "break" in the conductor thus results from erosion, not from physical migration of an underlying substrate.

Leslie U.S. Pat. No. 3,510,762, issued May 5, 1970, discloses a temperature monitoring device composed of a high frequency cable having a temperature sensitive dielectric. When the dielectric changes state at a certain location (melts or vaporizes), the impedance of the cable thereat changes, and the location can be detected by standard pulse echo techniques.

Simon et al. U.S. Pat. No. 3,595,228, issued July 27, 1971, discloses an electric alarm device for detecting a break in a releasable flow line coupling, such as a respirator.

Lewis U.S. Pat. No. 3,813,662, issued May 28, 1974, discloses an alarm system, which detects both open-circuiting of a loop and effective short-circuiting of the loop rectifier element.

Banner U.S. Pat. No. 3,898,641, issued Aug. 5, 1975, discloses a security rope containing wires coupled to a boat mooring bit such that an alarm is set off when the rope circuit is disturbed.

Cooke U.S. Pat. No. 4,288,425, issued Oct. 14, 1980, discloses a wire-containing alarm glass plate laminated to a plastic layer of polyvinyl butyral which becomes opaque upon breakage.

Clark et al. U.S. Pat. No. 4,236,146, issued Nov. 25, 1980, discloses a switchless circuit for constantly and simultaneously monitoring both open and closed circuits.

Lewiner et al. U.S. Pat. No. 4,263,589, issued Apr. 21, 1981, discloses an electromechanical device for detecting a break in a DC circuit.

Domingue (applicant herein) U.S. Pat. No. 4,520,352, issued May 28, 1985, discloses the concept of a fire alarm system and method in which the heat sensor comprises a continuous wire secured to or laminated or sandwiched between one or more sheets or films of heat migratable plastic whereby the application of heat on a localized basis, as in the case of a cigarette dropped on a bed, or on a more generalized basis, as in the case of an entire room or zone being brought to a somewhat elevated temperature, causes the plastic to shrink and break the wire, or allow the wire to separate by melting, to set off the associated alarm.

Japanese Pat. No. 144699 discloses another form of fire alarm system utilizing a heat shrinking plastic sheet or film for breaking an alarm wire.

SUMMARY OF THE INVENTION

Briefly, the present invention meets the above needs and purposes with an inexpensive, versatile, uncomplicated and reliable detection system and method which take advantage of the substantial reduction in tensile strength of plastic materials at predetermined elevated temperatures. In the preferred embodiment, a thermoplastic film is used which may or may not be heat shrinkable but when subjected to a moderate tension will break at a predetermined temperature. A thin foil conductor is adhered to the plastic, and when the plastic breaks it interrupts the continuity of the foil by breaking it, thereby activating a suitable alarm.

This invention is an improvement on Domingue (applicant herein) U.S. Pat. No. 4,520,352 which has a heat sensor comprising a continuous wire secured to or laminated or sandwiched between one or more sheets or films of heat migratable plastic whereby the application of heat on a localized basis, as in the case of a cigarette dropped on a bed, or on a more generalized basis, as in the case of an entire room or zone being brought to a somewhat elevated temperature, causes the plastic to shrink and break the wire, or allow the wire to separate by melting, to set off the associated alarm. In that invention, the temperature at which the alarm is set off depends on the heat migration temperature of a particular plastic film and is not variable. In this invention, the temperature at which the alarm is set off depends on the temperature at which the plastic film undergoes a rapid decrease in tensile strength and the tension applied to the film.

More specifically, in the preferred embodiment, a flexible tape of plastic film has a conductive wire, either round or a flat foil conductor of a material such as ordinary electrical solder supported thereon. Such a material has great tolerance for bending and pressure stresses. However, since it is made as a thin foil, its tensile strength is quite limited. In fact, the plastic substrate provides the major support for protecting the foil from fracture by tension. The wire or foil is either supported on the surface of a heavier film, or laminated between two film plies, or embedded in an extruded film.

A conventional continuity monitoring circuit detects the interruption of the continuity of the conductor foil or wire. The prior art shows numerous examples of appropriate and now well-known circuits which can perform this function, with little current drain for long life, and are safe for use in bedding, medical equipment, hazardous environments, and so forth. Any such detector circuit may be used, and is desirably connected to an alarm to generate an immediate alarm signal upon detection of breakage of the conductor.

It is therefore an object of the present invention to provide an improved fire alarm system and method utilizing a plastic film tape supporting a conductor which is broken at a predetermined temperature to set off an alarm circuit.

Another object of the invention is to provide an improved fire alarm system and method utilizing a plastic film tape supporting a conductor which is broken at a predetermined temperature to set off an alarm circuit, wherein the plastic film is one which undergoes a substantial decrease in tensile strength and the tape is subjected to a predetermined tension sufficient to be broken at a selected temperature.

Another object of the invention is to provide an improved fire alarm system and method utilizing a plastic film tape having a conductor foil adhered thereon or laminated therein which is broken at a predetermined temperature to set off an alarm circuit, wherein the plastic film is one which undergoes a substantial decrease in tensile strength and the tape is subjected to a predetermined tension sufficient to be broken at a selected temperature.

Still another object of the invention is to provide an improved fire alarm system and method utilizing a plastic film tape having a conductor foil adhered thereon or laminated therein which is broken at a predetermined temperature t set off an alarm circuit, wherein the plastic film is one which undergoes a substantial decrease in tensile strength and the tape is subjected to a predetermined tension sufficient to be broken at a selected temperature and which includes circuit continuity monitoring means connected to the conductor to detect breakage thereof.

Other objects and advantages of the invention will be apparent from the following description, the accompanying drawings and the appended claims.

DESCRIPTION OF THE PREFERRED EMBODIMENTS

Figure 1:
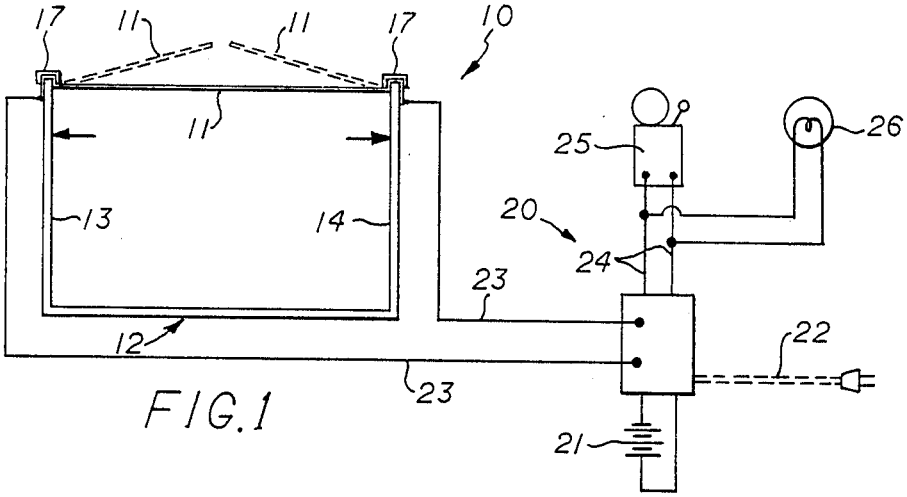
FIG. 1 is a somewhat schematic view of a preferred embodiment of the invention for detecting fires.

Referring to the drawings by numerals of reference, and more particularly to FIG. 1 there is shown a preferred embodiment 10 of the system of apparatus adapted for detecting a fire in any selected room or enclosure. System 10 is designed to have the temperature sensor portion located at a point where rapid rise in temperature is noticed early in a fire, e.g. near the ceiling.

System 10 comprises a thermal sensitive tape 11 supported on and stretched across a frame 12 having support members 13 and 14 spring biased outward to produce a predetermined tension in the tape 11. In this embodiment, frame 12 is a yoke having arms 13 and 14 of a spring-elastic material, e.g. steel or the like, which are sprung inward when tape 11 is secured thereon to provide the desired tension in the tape.

Figure 4:
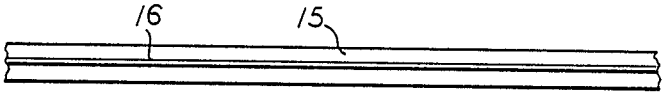
FIG. 4 is a plan view of one embodiment of the fire detecting tape used in this invention.
Figure 5:
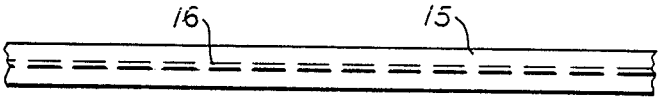
FIG. 5 is a plan view of a second embodiment of the fire detecting tape used in this invention.
Figure 6:
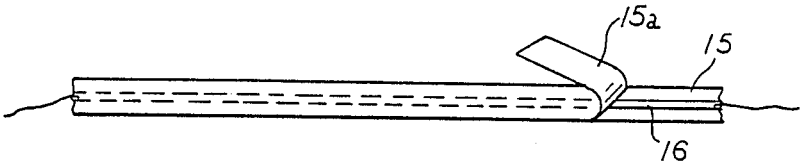
FIG. 6 is a plan view of a third embodiment of the fire detecting tape used in this invention.

The tape 11 is illustrated in three different embodiments in FIGS. 4, 5, and 6. Tape 11 is a plastic film or sheet material 15 having a conductor wire 16 supported thereon or therein. The terms "film" and "sheet", although often used in the plastics industry to distinguish materials according to their thicknesses, will be used indiscriminately herein since the overall physical properties are more important to the present invention than just the particular thickness of the material.

The plastic film or sheet material 15 is any suitable thermoplastic which undergoes a substantial and rapid decrease in tensile strength at a predetermined temperature. Examples of such plastics are polyvinyl chloride, polyethylene, polypropylene, rubber hydrochloride, polyvinylidene chloride, polyester, cellulose, and its derivatives, and nylon. The density or degree of polymerization of the plastic is not critical since the breaking temperature of the tape is set by a combination of factors, viz., thickness and width of the tape, temperature at which rapid drop in tensile strength occurs, and tension on the tape.

The plastic material 15 used in tape may be a stable plastic without an elastic memory or may be a material with an elastic memory created by orientation during manufacture. See, for example, "Firm and Sheeting Materials" in the Kirk-Othmer Encyclopedia of Chemical Technology, Third Edition, Volume 10, pp. 216–246 (1980), where heat-shrinkability is described as arising "from an elastic memory imparted to some thermoplastic films during their manufacture by either stretch orientation or by cross-linking induced through irradiation. Shrinkage takes place when heat is applied to the film, and it tends to revert to its original unoriented state." (pp. 217–227). This article lists fourteen heat-shrinkable materials generically (p. 226), and, throughout the article, lists and describes various properties and characteristics of these materials. For a listing of twenty-six suppliers of shrink films, see p. 759 of the Modern Plastics Encyclopedia 1982–1983.

Plastic sheets and films are available in many thicknesses, flexibilities, melting points, and temperature of rapid loss in tensile strength. The particular choice will depend, of course, upon the application at hand. In the preferred embodiment described herein, a low melting point thermoplastic material is preferred. Examples (see Kirk-Othmer, id.) include low density (LDPE) and medium density (MDPE) polyethylene (having melting points of about 250° F.), poly(-vinylidene chloride) (PVDC) (having a melting point of about 250° F.), methyl acrylate ethylene copolymer (having a melting point of about 140° F.), and vinyl acetate ethylene copolymer (having a melting point of about 150° F.).

A tape which breaks at a temperature of 135°–200° F. under a tension of 3.5 pounds is preferred for a tape width of about 0.75 in. and 3 mils thickness.

A 3 mil film of PVC (polyvinyl chloride) 0.75 in. wide breaks at a tension of 3.5 pounds at 135°–175° F., while it breaks at 300° F. at zero initial tension as a result of heat shrinkage at the higher temperature. A 3 mil film of LDPE (low density polyethylene) 0.75 in. wide breaks at a tension of 3.5 pounds at 145°–150° F., while it breaks at 250°–300° F. at zero initial tension as a result of heat shrinkage at the higher temperature. A 3.2 mil film of nylon-reinforced PVC (polyvinyl chloride) 0.75 in. wide breaks at 250° F. at zero initial tension as a result of heat shrinkage. When subjected to a higher tension, this film breaks at a lower temperature.

Virtually all plastic film or sheet materials break under tension at a lower temperature than the temperature at which heat shrinkage occurs. The precise temperature at which such breakage occurs may be determined accurately by experimentation and depends on a combination of factors, viz., thickness and width of the plastic material, temperature at which rapid drop in tensile strength occurs, and tension on the tape.

Conductor wire 16 supported on or in tape 11 may be a fine wire of circular cross section or may be a flat foil. The conductor wire 16 may be adhesively supported on the surface of the tape, as in FIG. 4; embedded inside a single ply tape during extrusion, as in FIG. 5; or laminated, adhesively or by heat sealing, between separate plies 15 and 15*a*, as in FIG. 6, or printed on one of the plies. Conductor wire 16 must have sufficient electrical conduction to operate the alarm circuit and be sufficiently low in tensile strength to break either by the force of heat shrinkage or of tension in the frame or yoke 12.

In the embodiment 10, a thin (e.g., 0.030" thick), very flexible (i.e., not brittle) polyethylene film 15 with a low melting point is recommended. The melting point is preferably 250° F. or less to provide an alarm response before temperatures are reached at which a cigarette burns (e.g., 1250° F.)

Conductor 16 is preferably made of a very soft, flexible material such as 20 S.W. 6 alloy SN60 solder film, 0.002"–0.004" thick, which is printed onto one of the sheets 15 or 15*a*. Such a conductor has mechanical properties which desirably withstand flexing and pressure in use but which readily breaks when the adjacent sheet 15 migrates upon application of sufficient heat thereto or under the tension in the frame or yoke 12. The SN60 alloy also has the high conductivity/low resistance desired for best results when used with an electrical continuity monitoring circuit as subsequently described. Other foils, such as typically seen on bank windows as part of intrusion alarm systems, are for the most part too brittle for applications involving flexing, but are satisfactory for static monitoring applications.

Figure 2:
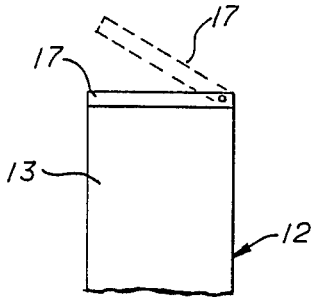
FIG. 2 is an end view of the embodiment of FIG. 1 showing one form of clamp for securing the fire detecting tape in position in the apparatus.
Figure 3:
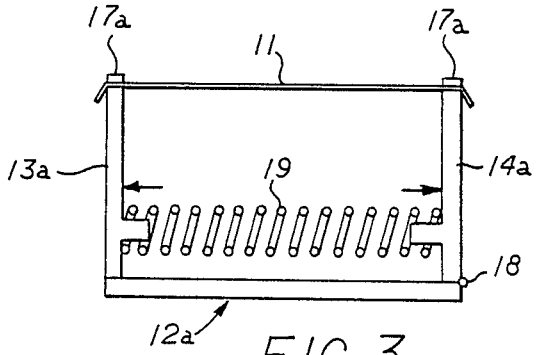
FIG. 3 is a view in elevation of another embodiment of the invention for detecting fires.

With reference to FIGS. 1 and 2, a channel-shaped clamp 17 on each of support members 13 and 14 clamps tape 11 in place under tension when the support members are sprung toward each other. In FIG. 3, there is shown an alternate embodiment of the support 12*a* having support members 13*a* and 14*a* and clamp 17*a*. Support member 13*a* is fixed in position, while support member 14*a* is pivotally supported as at 18. A coil spring 19 provides the outward tension on the tape 11 when supported on frame 12*a*. While clamps 17 and 17*a* are shown as channel-shaped clamps, any conventional clamp may be used to secure tape 11 in place. In both embodiments, the spring tension of support members 13 and 14 or of coil spring 19 may be varied by means well known in the prior art. In the embodiment of FIGS. 1 and 2, the tension of support members 13 and 14 is varied by the amount of deflection when the tape 11 is secured in place. If a shorter tape 11 is used, the support members 13 and 14 are deflected more and the tension is greater. In the embodiment of FIG. 3, the tension may be varied by using springs of different stiffness or by a suitable screw adjustment. Each of these methods of adjustment is well known in the prior art.

Electric monitoring circuit 20 may be any of the numerous monitoring circuits well known for security/-safety systems which monitor circuits for a break in continuity. As shown, a battery 21 provides power, assuring an alarm regardless of whether household AC current is available. Conventional testing and warning circuitry would also desirably be included to provide for testing the condition (such as by emitting an intermittent beep). An optional AC power line 22 is also shown. The electrical monitoring circuit 20 is connected to by leads 23 to the ends of wire conductor 16. Leads 24 connect circuit 24 to a suitable alarm device, such as a bell 25 and/or lamp 26.

OPERATION

While the construction and operation of this system and apparatus should be obvious from the foregoing description, a further description of installation and operation will be given for clarification.

As may be seen, the present invention has numerous advantages. It is inexpensive and versatile, and can provide a warning long before temperatures which would support combustion are reached. It can respond far more quickly in many critical applications.

The apparatus is installed with tape 11 stretched across frame or yoke 12 or 12*a* under tension of the spring arms 13 and 14 or spring 19 loaded arms 13*a* and 14*a*. Tape 11 may also be wrapped between the arms of a fixed frame and the ends of the tape pulled together by a spring to provide the desired tension in the tape to cause it to break at the selected temperature. Wire conductor 16 is connected in circuit 20 as described above. The circuit 20 is normally inactive under ordinary conditions of temperature. When ambient temperature adjacent to tape 11 heats the tape to its strength loss temperature, the tension on the tape breaks the tape 11 and wire conductor 16 to activate alarm 25 and/or 26.

A warning is given almost instantly—long before a nearby smoke detector would respond. The materials are readily and widely available, with ranges of physical properties which allow the invention to be tailored to particular needs. The present invention thus provides an inexpensive, uncomplicated, versatile and reliable fire alarm and heat detection system and method which lends itself to the widest possible use in giving early warning of a fire hazard, even before temperatures have risen to the point of combustion.

While the methods and forms of apparatus herein described constitute preferred embodiments of this invention, it is to be understood that the invention is not limited to these precise methods and forms of apparatus, and that changes may be made therein without departing from the scope of the invention.

I claim:

1. A fire alarm system comprising a thermoplastic film tape, of a plastic material having a substantial drop in tensile strength at a predetermined temperature, a conductor wire supported on and extending the entire length of said tape, means supporting said tape and wire under predetermined tension such that said tape and wire will break on occurrence of said predetermined temperature, circuit continuity monitoring means connected to said conductor wire to detect interruption thereof, and alarm means connected to said circuit monitoring means and operable to generate an alarm signal upon detection of the interruption of continuity of said conductor wire.

2. The system of claim 1 in which said wire is round in cross section and embedded in said tape.

3. The system of claim 1 in which said wire is a flat foil embedded in said tape.

4. The system of claim 1 in which said tape is formed of two separate film tapes, heat sealed or adhesively laminated together, said wire being a flat foil secured in or printed on said laminated tapes.

5. The system of claim 1 in which said tape is of a thermoplastic material having heat shrinking characteristics and said predetermined temperature is substantially lower than the temperature at which heat shrinkage occurs.

6. The system of claim 1 in which said tape is of a thermoplastic material which does not undergo heat shrinkage at temperatures up to said predetermined temperature.

7. The system of claim 1 in which said tape is about 0.75 in wide and 3 mils thick and breaks at a temperature of 135°-200° F. under a tension of 3.5 pounds.

8. The system of claim 1 in which said tape is of polyvinyl chloride, polyethylene, polypropylene, rubber hydrochloride, polyvinylidene chloride, polyester, or nylon.

9. The system of claim 1 including a supporting frame having supporting members, spring loaded apart, said tape being supported across said supporting members and said tension applied thereby.

10. The system of claim 1 including a supporting frame comprising a yoke having flexible supporting members, flexed toward each other spring loaded apart with said tape supported thereacross, and said tension applied thereby.

11. The system of claim 1 including means to vary said tension to predetermine said breaking temperature of said tape and wire.

12. The system of claim 1 including a supporting frame having supporting members, spring loaded apart, said tape being supported across said supporting members and said tension applied thereby, and said wire being round in cross section and embedded in said tape.

13. The system of claim 1 including a supporting frame having supporting members, spring loaded apart, said tape being supported across said supporting members and said tension applied thereby, and said wire being a flat foil embedded in or printed on said tape.

14. The system of claim 1 including a supporting frame having supporting members, spring loaded apart, said tape being supported across said supporting members and said tension applied thereby, and said tape being formed of two separate film tapes, heat sealed or adhesively laminated together, and said wire being a flat foil secured between or printed on said laminated tapes.

15. The system of claim 1 including a supporting frame having supporting members, spring loaded apart, said tape being supported across said supporting members and said tension applied thereby, and said tape beinq of a thermoplastic material having heat shrinking characteristics and said predetermined temperature being substantially lower than the temperature at which heat shrinkage occurs.

16. The system of claim 1 including a supporting frame having supporting members, spring loaded apart, said tape being supported across said supporting members and said tension applied thereby, and said tape being of a thermoplastic material which does not undergo heat shrinkage at temperature up to said predetermined temperature.

17. The system of claim 1 including a supporting frame comprising a yoke having flexible supporting members, flexed toward each other spring loaded apart with said tape supported thereacross, and said tension applied thereby, said wire being a flat foil embedded in said tape.

18. The system of claim 1 including a supporting frame comprising a yoke having flexible supporting members, flexed toward each other spring loaded apart with said tape supported thereacross, and said tension applied thereby, and said tape being formed of two separate film tapes, heat sealed or adhesively laminated together, sand said wire being a flat foil secured between said laminated tapes.

19. The system of claim 1 including a supporting frame comprising a yoke having flexible supporting members, flexed toward each other spring loaded apart with said tape supported thereacross, and said tension applied thereby, and said tape being of a thermoplastic material having heat shrinking characteristics and said predetermined temperature being substantially lower than the temperature at which heat shrinkage occurs.

20. The system of claim 1 including a supporting frame comprising a yoke having flexible supporting members, flexed toward each other spring loaded apart with said tape supported thereacross, and said tension applied thereby, and said tape being of a thermoplastic material which does not undergo heat shrinkage at temperature up to said predetermined temperature.

* * * * *